US008496230B1

(12) United States Patent
Jiron

(10) Patent No.: US 8,496,230 B1
(45) Date of Patent: Jul. 30, 2013

(54) WINCH MOUNTING SYSTEM

(76) Inventor: Richard A. Jiron, Aurora, CO (US)

( * ) Notice: Subject to any disclaimer, the term of this patent is extended or adjusted under 35 U.S.C. 154(b) by 0 days.

(21) Appl. No.: 13/422,249

(22) Filed: Mar. 16, 2012

Related U.S. Application Data

(60) Provisional application No. 61/465,287, filed on Mar. 17, 2011.

(51) Int. Cl.
*B66D 1/00* (2006.01)

(52) U.S. Cl.
USPC ..... 254/323; 280/425.2; 280/495; 280/496

(58) Field of Classification Search
USPC ..... 254/323; 280/425.2, 495, 496
See application file for complete search history.

(56) References Cited

U.S. PATENT DOCUMENTS

| | | | | |
|---|---|---|---|---|
| 2,927,772 | A * | 3/1960 | Kanouse | 254/323 |
| 3,159,368 | A * | 12/1964 | Ahlbin et al. | 248/222.41 |
| 3,973,754 | A * | 8/1976 | Chadwick, Jr. | 254/323 |
| 4,735,448 | A * | 4/1988 | Hart | 293/117 |
| D298,022 | S | 10/1988 | O'Rourke | |
| 5,522,582 | A * | 6/1996 | Dilks | 254/323 |
| 5,876,019 | A * | 3/1999 | Morrissey et al. | 254/323 |
| 6,095,545 | A | 8/2000 | Bol, II et al. | |
| 6,138,991 | A * | 10/2000 | Myers, Jr. | 254/323 |
| 6,409,202 | B1 | 6/2002 | Putnam | |
| 6,494,437 | B1 * | 12/2002 | Boyer | 254/323 |
| 6,530,738 | B2 * | 3/2003 | Maxwell | 414/462 |
| 7,198,443 | B2 | 4/2007 | Macomber, III | |
| 7,407,149 | B1 * | 8/2008 | Zindell | 254/323 |
| 7,828,317 | B2 | 11/2010 | Withers et al. | |
| 7,913,978 | B1 * | 3/2011 | Trihey et al. | 254/323 |
| 8,366,373 | B2 * | 2/2013 | Wood | 414/543 |
| 2006/0133916 | A1 | 6/2006 | Wood | |
| 2006/0201980 | A1 * | 9/2006 | Koons | 224/511 |
| 2008/0164448 | A1 * | 7/2008 | Duvall | 254/323 |
| 2009/0146119 | A1 * | 6/2009 | Bailey et al. | 254/323 |

* cited by examiner

*Primary Examiner* — Emmanuel M Marcelo

(57) ABSTRACT

A mounting system for securing a winch to a hauling platform has a mounting base with a mounting base table. The mounting base has an anchoring attachment, a leg, and a mounting attachment. Upon installation, a bottom member bottom surface rests against a hauling platform vertically projecting component expanded top lip top surface. A rear member front surface rests against a hauling platform vertically projecting component outside surface. A vertical clamp component front surface rests against a hauling platform vertically projecting component inside surface. An "L"-shaped screw clamping fastener clamps against a bottom surface of the hauling platform vertically projecting component expanded top lip. A screw clamping fastener is tightened to affix the mounting attachment into position. A leg second end rests against and is located on the hauling platform vertically projecting component inside surface. The system has a winch attached to the anchoring attachment.

8 Claims, 7 Drawing Sheets

WINCH MOUNTING SYSTEM

CROSS REFERENCE

This application claims priority to U.S. provisional application Ser. No. 61/465,287 filed Mar. 17, 2011, the specification of which is incorporated herein by reference in its entirety.

BACKGROUND OF THE INVENTION

Based on historic literature, the known use of winches has been around since at least the fifth century BC. Winches in common use today are varying forms of a similar basic design. Even though winches are often used on an around heavy equipment and in the construction industry, lighter duty versions are found among the standard tools of many homeowners. Often a user will use a winch with a ramp to load a mobile object into the bed of a pickup truck, since the pickup truck bed is typically elevated from a ground surface. The present invention teaches a novel winch mounting system to secure a winch in an advantageous location for use when loading a mobile object onto a hauling platform.

SUMMARY

The present invention features a mounting system for securing a winch to a hauling platform distal end. In some embodiments, the system comprises a mounting base. In some embodiments, the mounting base comprises a generally horizontal mounting base table. In some embodiments, the mounting base comprises an anchoring attachment generally centrally located on the table. In some embodiments, the mounting base comprises a leg, generally "C"-shaped in a vertical plane. In some embodiments, the mounting base comprises a generally horizontally longitudinal mounting attachment located on the leg bottom surface close to and generally parallel to a table anterior edge.

In some embodiments, the mounting attachment comprises a planar bottom member and a planar rear member. In some embodiments, a rear member top edge is located on a bottom member anterior edge. In some embodiments, an adjustable angular clamp is located on the mounting attachment.

In some embodiments, upon installation, a bottom member bottom surface of the mounting attachment rests against a hauling platform vertically projecting component expanded top lip top surface. In some embodiments, a rear member front surface of the mounting attachment rests against a hauling platform vertically projecting component outside surface. In some embodiments, a vertical clamp component front surface of the angular clamp rests against a hauling platform vertically projecting component inside surface. In some embodiments, an "L"-shaped screw clamping fastener clamps against a bottom surface of the hauling platform vertically projecting component expanded top lip. In some embodiments, a screw clamping fastener is tightened to affix the mounting attachment into position on a hauling platform vertically projecting component. In some embodiments, a leg second end rests against and is located on the hauling platform vertically projecting component inside surface to affix the mounting base table in a horizontal plane.

In some embodiments, the system comprises a winch. In some embodiments, the winch is attached to the anchoring attachment and can be removed if desired.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
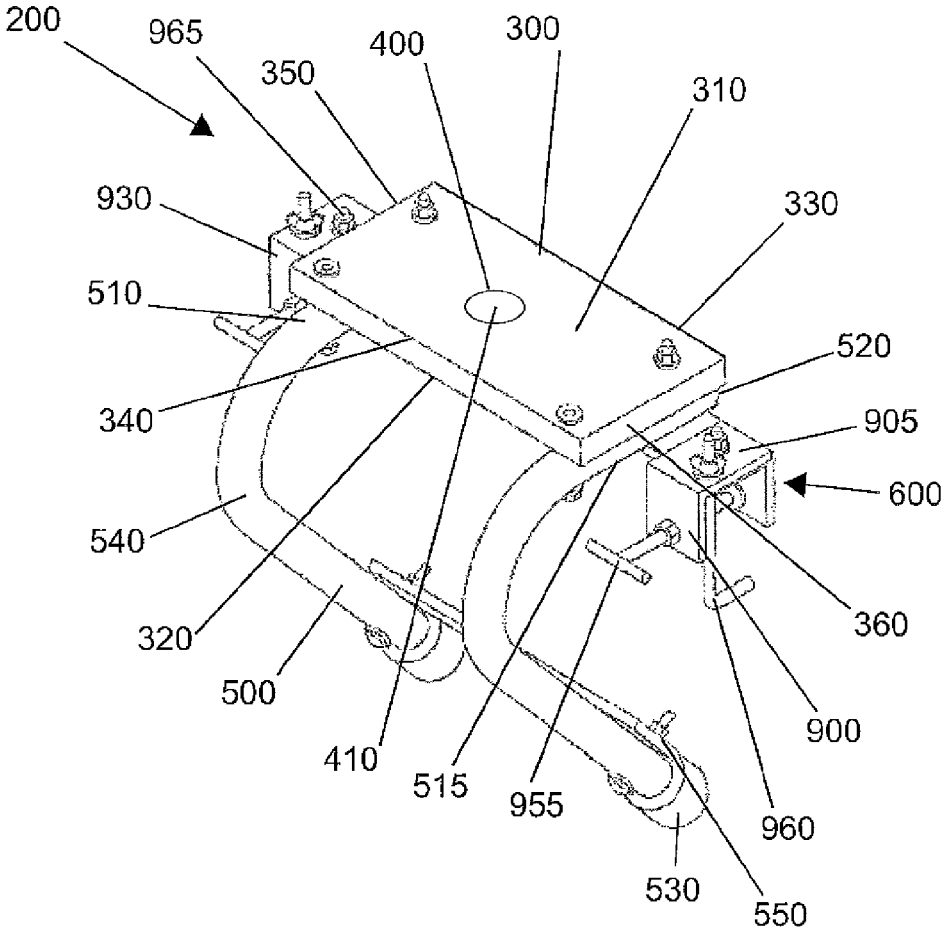
FIG. 1 is a perspective view of the mounting base of the present invention.

Following is a list of elements corresponding to a particular element referred to herein:

100 Mounting system
110 Winch
112 Winch control extension cord
114 Winch harness
116 Winch cable
117 Winch cable first end
118 Winch cable second end
120 Hauling platform
130 Hauling platform distal end
140 Hauling platform vertically projecting component
150 Hauling platform vertically projecting component expanded top lip
160 Hauling platform vertically projecting component outside surface
170 Hauling platform vertically projecting component inside surface
180 Trailer hitch ball
200 Mounting base
300 Mounting base table
310 Table top surface
320 Table bottom surface
330 Table anterior edge
340 Table posterior edge
350 Table first side
360 Table second side
400 Anchoring attachment
410 Aperture
420 Attaching ring
500 Leg
510 Leg top surface
515 Leg bottom surface
520 Leg first end
530 Leg second end
540 Leg middle section
550 Leg brace
600 Mounting attachment
700 Bottom member
710 Bottom member top surface
720 Bottom member bottom surface
730 Bottom member anterior edge
740 Bottom member posterior edge

Figure 2:
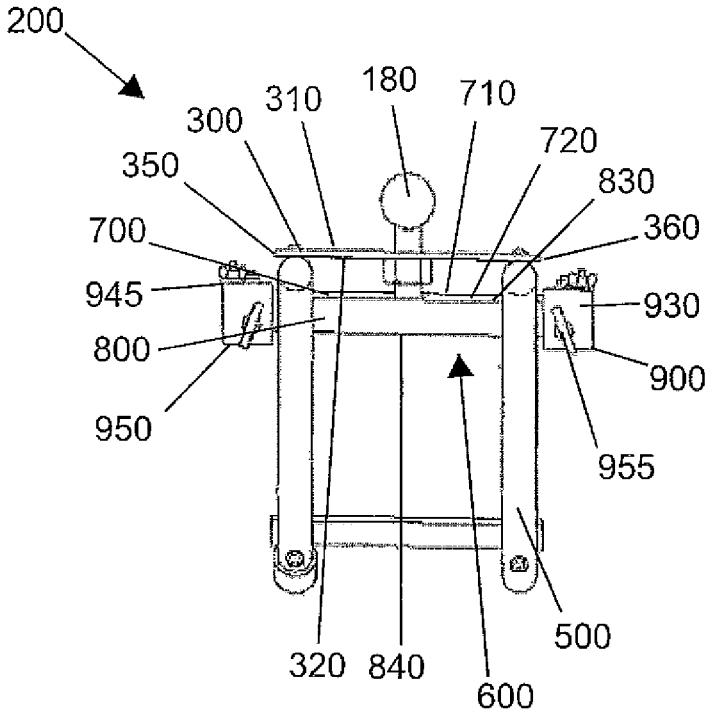
FIG. 2 is a front view of the mounting base of the present invention.
Figure 3:
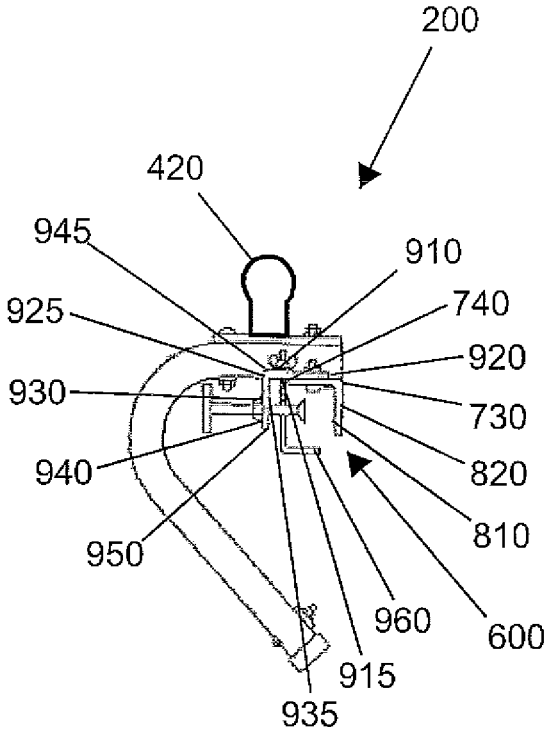
FIG. 3 is a side view of the mounting base of the present invention.
Figure 4:
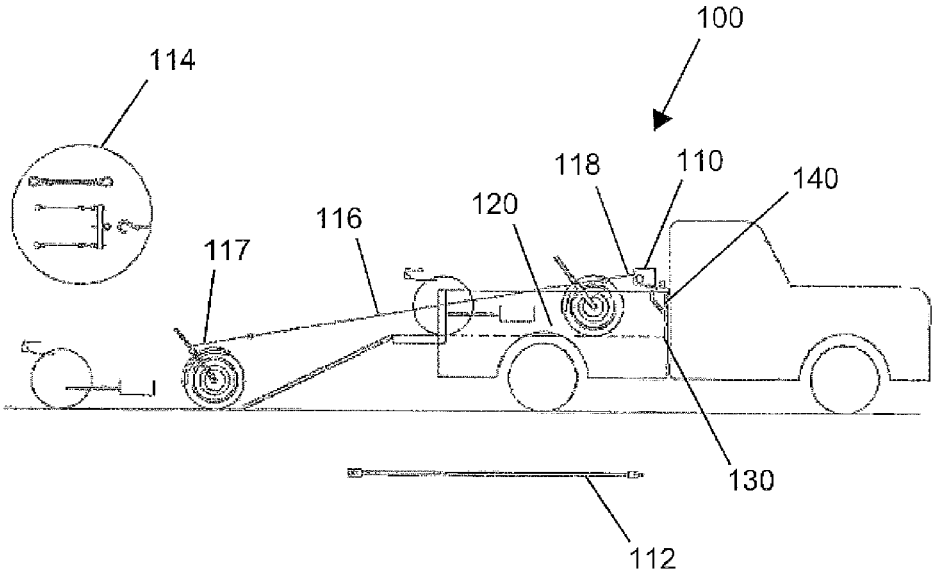
FIG. 4 is a side view of the present invention.
Figure 5:
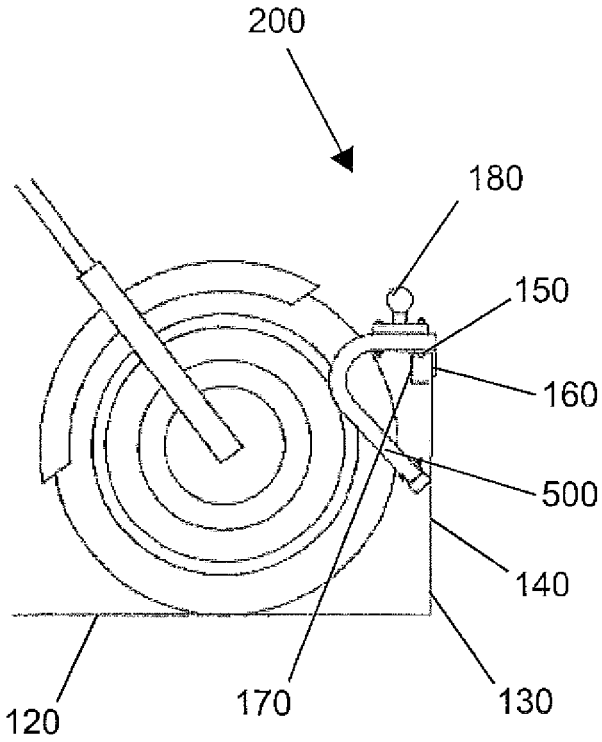
FIG. 5 is a side view of the present invention.
Figure 6:
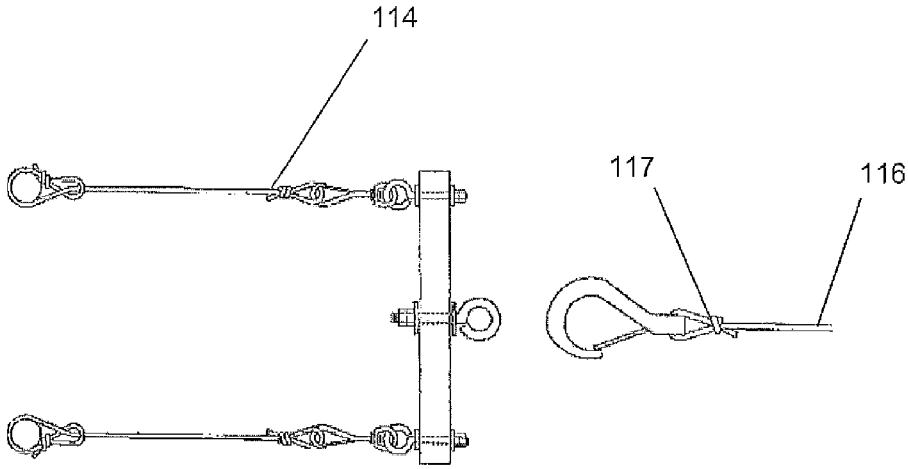
FIG. 6 is a top view of the winch harness of the present invention.
Figure 7:
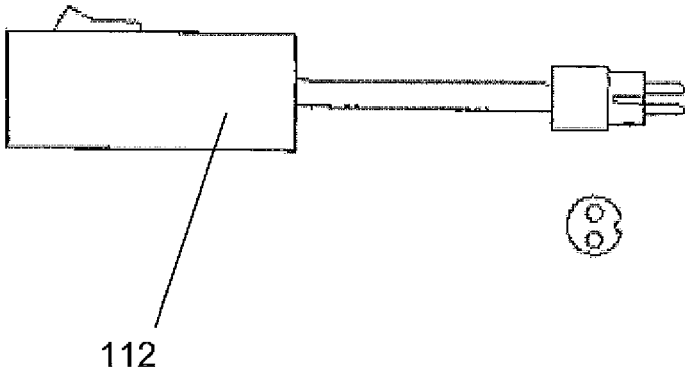
FIG. 7 is a side view of the winch control extension cord of the present invention.

800 Rear member
810 Rear member front surface
820 Rear member back surface
830 Rear member top edge
840 Rear member bottom edge
900 Angular clamp
905 Horizontal clamp component
910 Horizontal clamp component top surface
915 Horizontal clamp component bottom surface
920 Horizontal clamp component anterior edge
925 Horizontal clamp component posterior edge
930 Vertical clamp component
935 Vertical clamp component front surface
940 Vertical clamp component back surface
945 Vertical clamp component top edge
950 Vertical clamp component bottom edge
955 Screw clamping fastener
960 "L"-shaped screw clamping fastener
965 Fastener Referring now to FIGS. 1-7, the present invention features a mounting system (100) for securing a winch (110) to a hauling platform distal end (130). In some embodiments, the system (100) comprises a mounting base (200). In some embodiments, the mounting base (200) comprises a generally horizontal mounting base table (300) having a table top surface (310), a table bottom surface (320), a table anterior edge (330), a table posterior edge (340), a table first side (350), and a table second side (360).

In some embodiments, the mounting base (200) comprises an anchoring attachment (400) generally centrally located on the table.

In some embodiments, the mounting base (200) comprises a leg (500), generally "C"-shaped in a vertical plane, having a leg top surface (510), a leg bottom surface (515), a leg first end (520), a leg second end (530), and a radial bend located in a leg middle section (540). In some embodiments, the leg top surface (510) of the leg first end (520) is located on the table bottom surface (320). In some embodiments, the leg (500) is located generally perpendicular to the table anterior edge (330). In some embodiments, the leg (500) is located generally perpendicular to the table bottom surface (320). In some embodiments, the leg middle section (540) projects generally out and away from the table posterior edge (340). In some embodiments, the leg second end (530) curves and projects downwardly from and away from the table bottom surface (320). In some embodiments, the leg second end (530) curves and projects back toward a vertical plane comprising the table anterior edge (330).

In some embodiments, the mounting base (200) comprises a generally horizontally longitudinal mounting attachment (600) located on the leg bottom surface (515) close to and generally parallel to the table anterior edge (330). In some embodiments, the mounting attachment (600) comprises a planar bottom member (700) having a bottom member top surface (710), a bottom member bottom surface (720), a bottom member anterior edge (730), and a bottom member posterior edge (740). In some embodiments, the mounting attachment comprises a planar rear member (800) having a rear member front surface (810), a rear member back surface (820), a rear member top edge (830), and a rear member bottom edge (840). In some embodiments, the rear member top edge (830) is located on the bottom member anterior edge (730).

In some embodiments, an adjustable angular clamp (900) is located on the mounting attachment (600). In some embodiments, the angular clamp (900) comprises a horizontal clamp component (905) having a horizontal clamp component top surface (910), a horizontal clamp component bottom surface (915), a horizontal clamp component anterior edge (920), and a horizontal clamp component posterior edge (925). In some embodiments, the angular clamp (900) comprises a vertical clamp component (930) having a vertical clamp component front surface (935), a vertical clamp component back surface (940), a vertical clamp component top edge (945), and a vertical clamp component bottom edge (950). In some embodiments, the vertical clamp component top edge (945) is located on the horizontal clamp component posterior edge (925).

In some embodiments, the vertical clamp component (930) comprises a generally horizontally located screw clamping fastener (955) located therein in a manner facilitating rotation. In some embodiments, the horizontal clamp component (905) comprises a generally vertically located "L" shaped screw clamping fastener (960) located therein in a manner facilitating rotation.

In some embodiments, the horizontal clamp component bottom surface (915) is adjustably located on and affixed to the bottom member top surface (710) of the mounting attachment (600) via a fastener (965).

In some embodiments, upon installation, the bottom member bottom surface (720) of the mounting attachment (600) rests against a hauling platform vertically projecting component expanded top lip top surface (155). In some embodiments, the rear member front surface (810) of the mounting attachment (600) rests against a hauling platform vertically projecting component outside surface (160). In some embodiments, the vertical clamp component front surface (935) of the angular clamp (900) rests against a hauling platform vertically projecting component inside surface (170). In some embodiments, the "L"-shaped screw clamping fastener (960) clamps against a bottom surface of the hauling platform vertically projecting component expanded top lip (150). In some embodiments, the screw clamping fastener is tightened to affix the mounting attachment (600) into position on the hauling platform vertically projecting component (140).

In some embodiments, the leg second end (530) rests against and is located on a hauling platform vertically projecting component inside surface (170) to affix the mounting base table (300) in a horizontal plane.

In some embodiments, the system (100) comprises a winch (110). In some embodiments, the winch (110) is attached to the anchoring attachment (400) and can be easily removed.

In some embodiments, the system (100) comprises a plurality of legs (500) located in a horizontally planar offset from one another. In some embodiments, the spacing between the legs (500) is adjustable in a horizontal plane. In some embodiments, the plurality of legs (500) can be used to anchor a mobile object located on the hauling platform (120). In some embodiments a tire or wheel of the mobile object can be secured between two legs (500).

In some embodiments, the system (100) comprises a winch control extension cord (112) operatively connected to the winch (110).

In some embodiments, the system (100) comprises a winch harness (114) for attaching to a mobile object to be loaded on the hauling platform (120), wherein a winch cable first end (117) is attached to the winch harness (114), wherein a winch cable second end (118) is attached to the winch (110). In some embodiments, the winch harness (114) comprises a "U"-shape.

In some embodiments, the anchoring attachment (400) comprises an aperture (410) located on the mounting base table (300).

In some embodiments, the anchoring attachment (400) comprises an attaching ring (420) located on the mounting base table (300).

In some embodiments, the anchoring attachment (400) comprises a trailer hitch ball (180) located on the mounting base table (300).

In some embodiments, the mounting attachment (600) is located on the table bottom surface (320).

In some embodiments, a leg brace (550) comprises a leg brace first end disposed on a first leg (500) close to the first leg second end (530). In some embodiments, a leg brace (550) comprises a leg brace second end disposed on a second leg (500) close to the second leg second end (530).

In some embodiments, the leg (500) is tubular. In some embodiments a protective cap is disposed on the leg first end (520). In some embodiments, a protective cap is disposed on the leg second end (530). In some embodiments, a protective plug is disposed on the leg first end (520). In some embodiments, a protective plug is disposed on the leg second end (530).

In some embodiments, the mounting base table (300) is constructed from wood. In some embodiments, the mounting base table (300) is constructed from metal. In some embodiments, the mounting base (200) is constructed from metal.

In some embodiments, the mounting attachment (600) is coated with a mar resistant coating. An example of a mar resistant coating would be a rubber or a plastic.

As used herein, the term "about" refers to plus or minus 10% of the referenced number. For example, an embodiment wherein the mounting base is about 10 inches in length includes a mounting base that is between 9 and 11 inches in length.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

The disclosure of the following U.S. Patents are incorporated in their entirety by reference herein: U.S. Pat. No. D298022; U.S. Pat. No. 6,095,545; U.S. Pat. No. 6,409,202; U.S. Pat. No. 7,198,443; U.S. Pat. No. 7,828,317; U.S. Pat. App. No. 2006/0133916.

What is claimed is:

1. A mounting system (100) for securing a winch (110) to a hauling platform distal end (130), wherein said system (100) comprises:

(a) a mounting base (200) comprising:

(i) a generally horizontal mounting base table (300) comprising a table top surface (310), a table bottom surface (320), a table anterior edge (330), a table posterior edge (340), a table first side (350), and a table second side (360), (ii) an anchoring attachment (400) generally centrally disposed on the table, (iii) a leg (500), generally "C"-shaped in a vertical plane, having a leg top surface (510), a leg bottom surface (515), a leg first end (520), a leg second end (530), and a radial bend disposed in a leg middle section (540), wherein the leg top surface (510) of the leg first end (520) is disposed on the table bottom surface (320), wherein the leg (500) is disposed generally perpendicular to the table anterior edge (330), wherein the leg (500) is disposed generally perpendicular to the table bottom surface (320), wherein the leg middle section (540) projects generally out and away from the table posterior edge (340), wherein the leg second end (530) curves and projects downwardly from and away from the table bottom surface (320), wherein the leg second end (530) curves and projects back toward a vertical plane comprising the table anterior edge (330), and (iv) a generally horizontally longitudinal mounting attachment (600) disposed on the leg bottom surface (515) proximal to and generally parallel to the table anterior edge (330), wherein the mounting attachment (600) comprises a planar bottom member (700) having a bottom member top surface (710), a bottom member bottom surface (720), a bottom member anterior edge (730), and a bottom member posterior edge (740), and a planar rear member (800) having a rear member front surface (810), a rear member back surface (820), a rear member top edge (830), and a rear member bottom edge (840), wherein the rear member top edge (830) is disposed on the bottom member anterior edge (730), wherein an adjustable angular clamp (900) is disposed on the mounting attachment (600) comprising a horizontal clamp component (905) having a horizontal clamp component top surface (910), a horizontal clamp component bottom surface (915), a horizontal clamp component anterior edge (920), and a horizontal clamp component posterior edge (925), wherein the angular clamp (900) further comprises and a vertical clamp component (930) having a vertical clamp component front surface (935), a vertical clamp component back surface (940), a vertical clamp component top edge (945), and a vertical clamp component bottom edge (950), wherein the vertical clamp component top edge (945) is disposed on the horizontal clamp component posterior edge (925), wherein the vertical clamp component (930) comprises a generally horizontally disposed screw clamping fastener (955) rotatably disposed therein, wherein the horizontal clamp component (905) comprises a generally vertically disposed "L" shaped screw clamping fastener (960) rotatably disposed therein, wherein the horizontal clamp component bottom surface (915) is adjustably disposed on and affixed to the bottom member top surface (710) of the mounting attachment (600) via a fastener (965), wherein upon installation, the bottom member bottom surface (720) of the mounting attachment (600) rests against a hauling platform vertically projecting component expanded top lip top surface (155), wherein the rear member front surface (810) of the mounting attachment (600) rests against a hauling platform vertically projecting component outside surface (160), wherein the vertical clamp component front surface (935) of the angular clamp (900) rests against a hauling platform vertically projecting component inside surface (170), wherein the "L"-shaped screw clamping fastener (960) clamps against a bottom surface of the hauling platform vertically projecting component expanded top lip (150), wherein the screw clamping fastener is tightened to affix the mounting attachment (600) into position on the hauling platform vertically projecting component (140), wherein the leg second end (530) rests against and is disposed on a hauling platform vertically projecting component inside surface (170) to affix the mounting base table (300) in a horizontal plane; and (b) a winch (110), wherein the winch (110) is removably attached to the anchoring attachment (400).

2. The system (100) of claim 1, wherein the system (100) comprises a plurality of legs (500) disposed in a horizontally planar offset from one another, wherein the spacing between the legs (500) is adjustable in a horizontal plane, wherein the plurality of legs (500) can be used to anchor a mobile object on the hauling platform (120).

3. The system (100) of claim 1, wherein the system (100) comprises a winch control extension cord (112) operatively connected to the winch (110).

4. The system (100) of claim 1, wherein the system (100) comprises a winch harness (114) for attaching to a mobile object to be loaded on the hauling platform (120), wherein a winch cable first end (117) is attached to the winch harness (114), wherein a winch cable second end (118) is attached to the winch (110).

5. The system (100) of claim 1, wherein the anchoring attachment (400) comprises an aperture (410) disposed on the mounting base table (300).

6. The system (100) of claim 1, wherein the anchoring attachment (400) comprises an attaching ring (420) disposed on the mounting base table (300).

7. The system (100) of claim 1, wherein the anchoring attachment (400) comprises a trailer hitch ball (180) disposed on the mounting base table (300).

8. The system (100) of claim 1, wherein the mounting attachment (600) is disposed on the table bottom surface (320).

* * * * *